US008215987B2

(12) United States Patent
Yoshioka et al.

(10) Patent No.: US 8,215,987 B2
(45) Date of Patent: Jul. 10, 2012

(54) FLUIDPROOF CONNECTOR

(75) Inventors: Chikahiro Yoshioka, Yokkaichi (JP); Tomohiko Kobayashi, Yokkaichi (JP); Shinji Hirano, Yokkaichi (JP); Masatoshi Itou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/899,225

(22) Filed: Oct. 6, 2010

(65) Prior Publication Data

US 2011/0086544 A1 Apr. 14, 2011

(30) Foreign Application Priority Data

Oct. 13, 2009 (JP) ..... 2009-235949

(51) Int. Cl.
*H01R 13/52* (2006.01)

(52) U.S. Cl. ..... 439/587

(58) Field of Classification Search ..... 439/587, 439/589, 588, 271, 275, 595, 752
See application file for complete search history.

(56) References Cited

U.S. PATENT DOCUMENTS 6,071,147 A 6/2000 Tsukamoto
6,179,671 B1 * 1/2001 Ohsumi ..... 439/752
6,383,020 B2 * 5/2002 Taguchi et al. ..... 439/587

* cited by examiner

*Primary Examiner* — Alexander Gilman
(74) *Attorney, Agent, or Firm* — Gerald E. Hespos; Michael J. Porco

(57) ABSTRACT

A retainer (40), a rubber plug (60) and a rubber plug pressing member (70) are mounted in a housing (10). The retainer (40) is movable between a partial locking position and a full locking position, and the rubber plug pressing member (70) is movable between an initial position and a pushed-in position. The rubber plug pressing member (70) is formed with arm portions (74) projecting therefrom. The retainer (40) is formed with unlock linking portions (46) for linking a movement of this retainer (40) from the full locking position to the partial locking position and a movement of the rubber plug pressing member (70) from the pushed-in position to the initial position with each other by coming into sliding contact with the arm portions (74).

11 Claims, 12 Drawing Sheets

FLUIDPROOF CONNECTOR

BACKGROUND OF THE INVENTION

1. Field of the Invention

The invention relates to a fluidproof connector.

2. Description of the Related Art

U.S. Pat. No. 6,071,147 discloses a waterproof connector with a housing, a retainer, a rubber plug, a rear cover and terminal fittings. The housing is formed with cavities for receiving the terminal fittings. The retainer is movable between a partial locking position and a full locking position. The retainer includes retaining portions that are retracted from the cavities at the partial locking position to permit insertion and withdrawal of the terminal fittings into and from the cavities. However, the retaining portions enter the cavities at the full locking position to retain the terminal fittings. The rubber plug is formed with through holes, into which wires connected with the terminal fittings are inserted after the passage of the terminal fittings.

The rubber plug and the rear cover are united to form a rubber plug unit. A mounting recess is formed in the rear surface of the housing, and the rubber plug unit is mounted into the mounting recess from behind. The rubber plug unit is movable between an initial position and a pushed-in position. No radially inwardly acting compressive force is exerted on the rubber plug at the initial position so that the terminal fittings are inserted smoothly into the through holes. However, a radially inwardly acting compressive force is exerted on the rubber plug at the pushed-in position so that the inner circumferential surfaces of the through holes closely contact the wires.

The rubber plug unit and the retainer must be moved separately in the above-described conventional waterproof connector. Thus, the retainer must be returned to the partial locking position and the rubber plug unit must be returned to the initial position before the terminal fittings can be withdrawn. Workers are not accustomed to moving the rubber plug, and hence may forget to move the rubber plug unit to the initial position when the retainer is moved to the partial locking position. Then, the terminal fittings have to pass the narrow through holes of the rubber plug in a compressed state, and the inner circumferential surfaces of the through holes might be damaged by interference with the terminal fittings.

The invention was developed in view of the above situation and an object thereof is to prevent a terminal fitting from damaging a resilient plug.

SUMMARY OF THE INVENTION

The invention relates to a water- or fluidproof connector with a housing formed with at least one cavity for receiving a terminal fitting. A retainer is mounted to the housing for movement between first and second positions. The retainer has at least one retaining portion that is outside the cavity when the retainer is at the first position so that the terminal fitting can be inserted and withdrawn. However, the retaining portion projects into the cavity when the retainer is at the second position for locking the terminal fitting in the cavity. A resilient plug is mounted into the housing and has at least one through hole to be held in close contact with the outer circumferential surface of a wire connected to the terminal fitting after the passage of the terminal fitting. A resilient plug pressing member is mounted to the housing for movement between an initial position and a pushed-in position with respect to the housing and compresses the resilient plug at the pushed-in position. The resilient plug pressing member includes at least one arm, and the retainer includes at least one unlock link that slides in contact with the arm for linking a movement of the retainer from the second position to the first position and a movement of the resilient plug pressing member from the pushed-in position to the initial position.

The unlock link slides in contact with the arm If the resilient plug pressing member can be returned from the pushed-in position to the initial position when withdrawing the terminal fitting from the housing. The retainer can follow this movement of the resilient plug pressing member and moves from the second position to the first position. Further, the unlock link slides in contact with the arm if the retainer can be returned from the second position to the first position. Thus, the resilient plug pressing member can follow this movement of the retainer and returns from the pushed-in position to the initial position. Accordingly, it is not necessary to move the retainer to the first position and separately to move the resilient plug pressing member to the initial position, thereby mitigating a work load and preventing the resilient plug pressing member from being left unmoved.

The resilient plug pressing member returns to the initial position if the retainer returns to the first position. Thus, a compressed state of the resilient plug is released when withdrawing the terminal fitting, thereby avoiding large frictional resistance between the terminal fitting and the inner surface of the through hole when the terminal fitting passes the through hole. Thus, the terminal fitting will not damage the resilient plug.

The resilient plug pressing member preferably is configured to hold the resilient plug lightly between itself and the housing lightly at the initial position and to hold the resilient plug strongly between itself and the housing to compress the resilient plug at the pushed-in position, The retainer preferably has at least one mount linking portion for linking a movement of the retainer from the first position to the second position and a movement of the resilient plug pressing member from the initial position to the pushed-in position with each other by coming substantially into sliding contact with the arm.

The retainer preferably is formed with a mount link for linking a movement of the retainer from the partial locking position to the full locking position and a movement of the rubber plug pressing member from the initial position to the pushed-in position by sliding in contact with the arm.

The resilient plug preferably has at least one insertion hole with a sealing surface that closely contacts an outer peripheral surface of the arm at the pushed-in position. Thus fluid or water cannot enter the housing through the outer peripheral surface of the arm, and the presence of the arm does not degrade fluid- or waterproofness.

At least one lip preferably projects from the inner surface of the insertion hole, and the sealing surface is formed on the lip.

At least one projection may be formed on a front surface of the resilient plug with respect to a mounting direction into the housing and at least one recess may be formed in a surface of the housing to be held in contact with the resilient plug. The projection is squeezed into close contact with an inner surface of the recess at the pushed-in position. The projection and the recess ensure good fluid- or waterproofness.

The projection and the recess preferably are formed over their entire peripheries of edge portions of the respective surfaces of the resilient plug and the housing. Thus, the housing is sealed completely around the periphery to achieve better fluid- or waterproofness.

The resilient plug pressing member preferably compresses the resilient plug at the pushed-in position to deform the plug at the through hole and bring the plug into closer contact with the terminal fitting and/or the wire.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
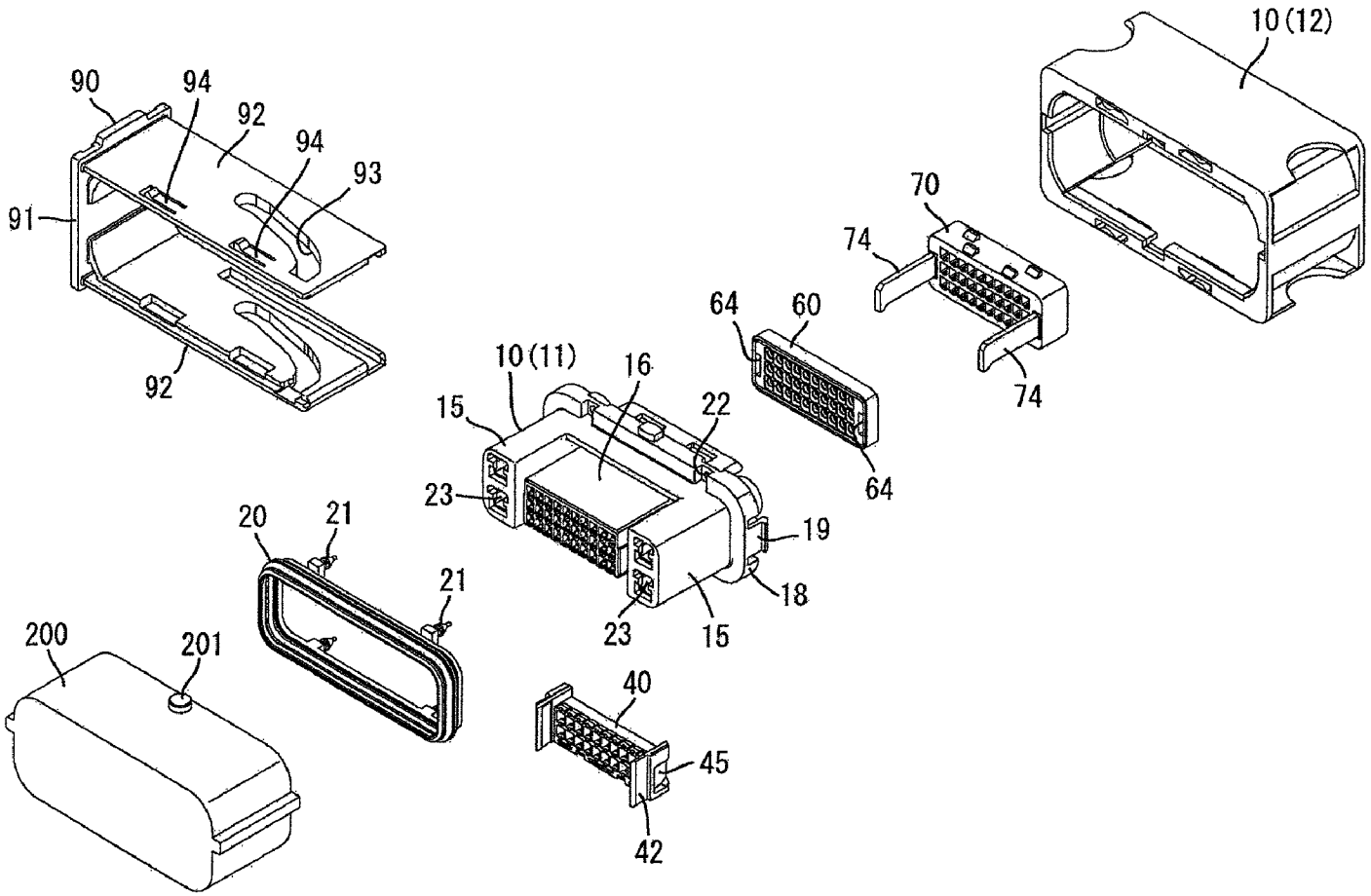
FIG. 1 is an exploded perspective view of a waterproof connector according to one embodiment.

A waterproof connector in accordance with the invention is illustrated in FIGS. 1 to 12. This waterproof connector has a housing 10, a retainer 40, a rubber plug 60, a rubber plug pressing member 70, a movable member, such as a lever 90, and terminal fittings 100. The housing 10 is connectable with a mating housing 200. In the following description, an end to be connected with the mating housing 200 is referred to as the front end concerning forward and backward directions.

The housing 10 is made e.g. of synthetic resin and has an inner housing 11 and an outer housing 12 separable from each other. The outer housing 12 is a generally wide rectangular tube with open front and rear ends. Two unillustrated engaging portions are formed on the inner surfaces of opposite side walls of the outer housing 12. Further, two entrance holes 13 are formed at upper and lower ends of one side wall of the outer housing 12.

The lever 90 is made e.g. of synthetic resin and has a substantially rectangular coupling plate 91 that covers an outer surface of one side wall of the outer housing 12. Two substantially parallel projecting plates 92 project from upper and lower ends of the coupling plate 91. Each projecting plate 92 has a cam groove 93 and two resilient locking pieces 94 that are spaced apart in the width direction. The projecting plates 92 are inserted laterally into the respective entrance holes 13 of the outer housing 12. The lever 90 then can be moved in the width direction between a standby position and a connection position with respect to the outer housing 12. In this regard, the width direction is substantially orthogonal to a connecting direction and extends along a longer side of the housing 10. The respective resilient locking pieces 94 engage inner surfaces of the outer housing 12 when the lever 90 is at the standby position and at the connection position to restrict movement of the lever 90 from the respective standby and connection positions. The mating housing 200 is fit partly into the outer housing 12 and upper and lower cam followers 201 on the mating housing 200 enter the corresponding cam grooves 93 when the lever 90 is at the standby position. The lever 90 then is slid in the width direction toward the connection position. As a result, the cam followers 201 slide on surfaces of the cam grooves 93 to exhibit a cam action that assists in or performs a connecting operation of the two housings 10, 200.

The inner housing 11 is in the form of a block that has a wide housing main body 14. Two side towers 15 project forward from opposite widthwise sides of the housing main body 14, and a central tower 16 projects forward from a substantially widthwise central part of the housing main body 14. Clearances are defined between the central tower 16 and the side towers 15.

Figure 2:
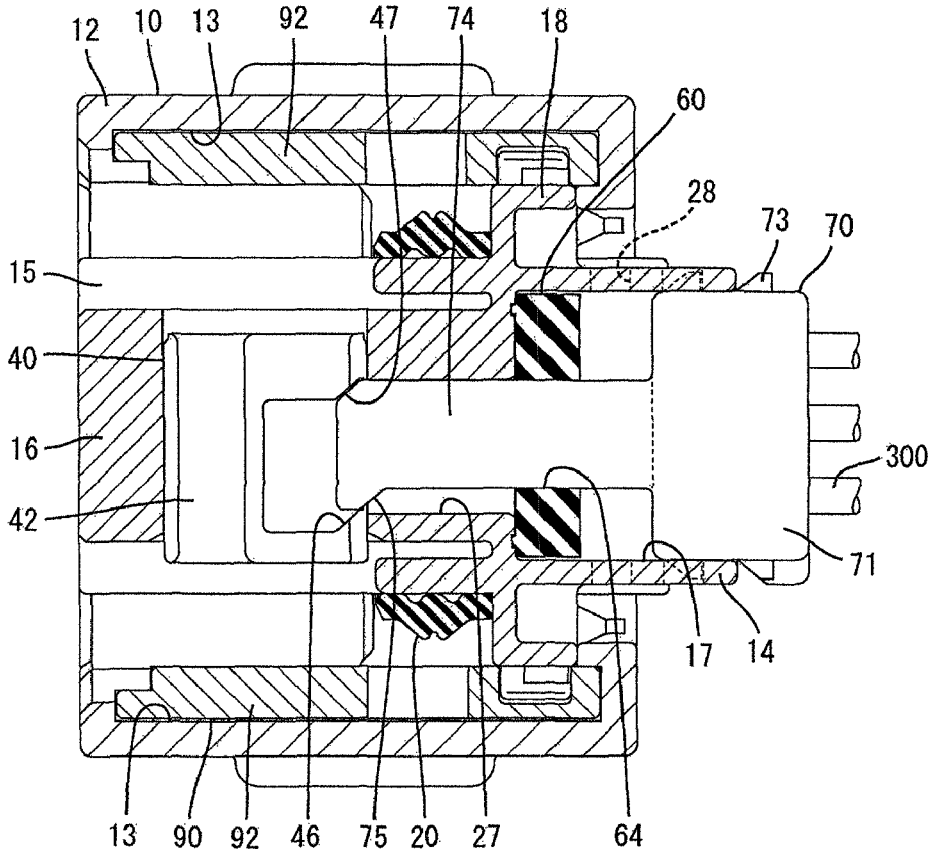
FIG. 2 is a sectional view showing a state where a rubber plug pressing member is at an initial position and a retainer is at a partial locking position.

A mounting recess 17 is formed in the rear surface of the housing main body 14, as shown in FIG. 2 and can receive the rubber plug 60 and the rubber plug pressing member 70. The mounting recess 17 is arranged back to back with the central tower 16, and the front end of the mounting recess 17 reaches the front end of the housing main body 14 and communicates with small cavities 24 in the central tower 16.

An elongated projection 18 projects over substantially the entire outer periphery of the housing main body 14, and two resiliently deformable locks 19 are formed at opposite lateral sides of the elongated projection 18. The locks 19 engage engaging portions when the inner housing 11 is inserted properly into the outer housing 12 and hold the inner housing 11 in the outer housing 12. A seal ring 20 is mounted on the outer surface of the housing main body 14. Upper and lower pairs of projections 21 project back on the seal ring 20 and align with receiving holes 22 in the elongated projection 18. The seal ring 20 closely contacts the front surface of the elongated projection 18 when mounted properly on the housing main body 14 and the respective projections 21 enter the corresponding receiving holes 22 to hold the seal ring 20 on the housing main body 14.

Figure 4:
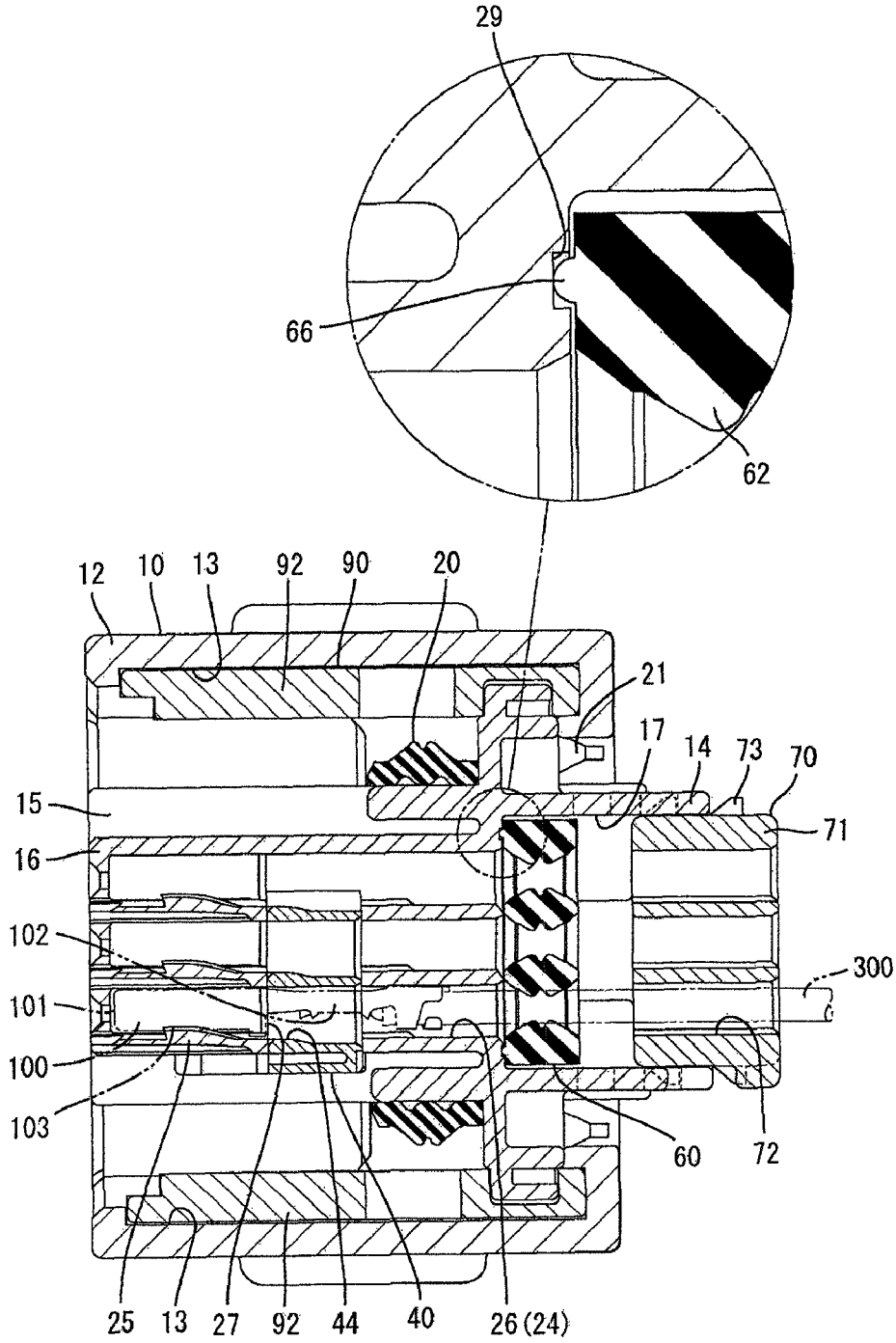
FIG. 4 is a sectional view showing a state where the rubber plug pressing member is at the initial position and a projection of a rubber plug is lightly fitted in a recess.

Upper and lower large cavities 23 are formed in each of the side towers 15, and small cavities 24 are formed substantially side by side in the width direction at upper, middle and lower levels in the central tower 16. Large terminal fittings 100 are inserted from behind into the respective large cavities 23 and small terminal fittings 100 are inserted from behind into the small cavities 24. As shown in FIG. 4, resiliently deformable locking lances 25 are formed at inner surfaces of the respective large and small cavities 23 and 24 and retain the terminal fittings 100 that have been inserted properly into the respective cavities 23, 24.

A mounting hole 27 is formed in the lower surface of the central tower 16 for receiving the retainer 40. The mounting hole 27 communicates with the small cavities 24, and the retainer 40 can slide on the inner surfaces of the mounting hole 27.

Figure 9:
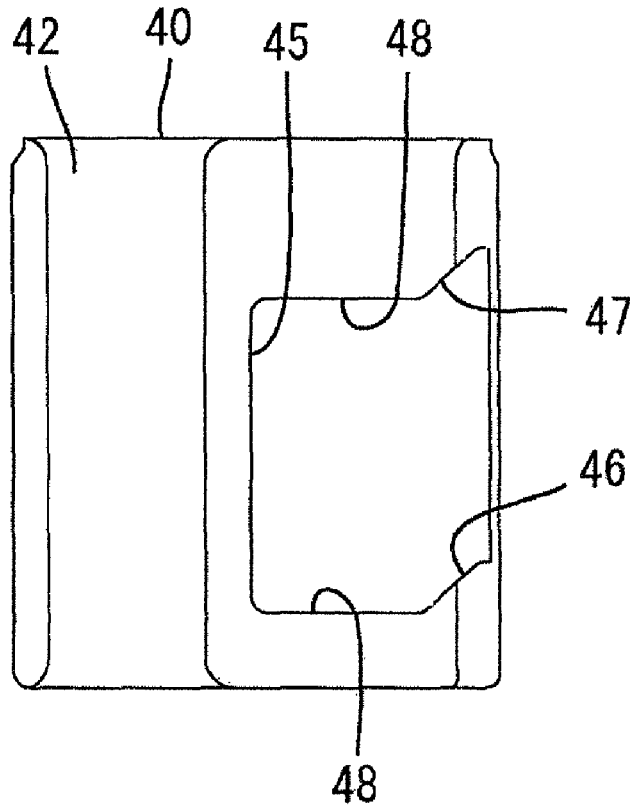
FIG. 9 is a side view of the retainer.
Figure 10:
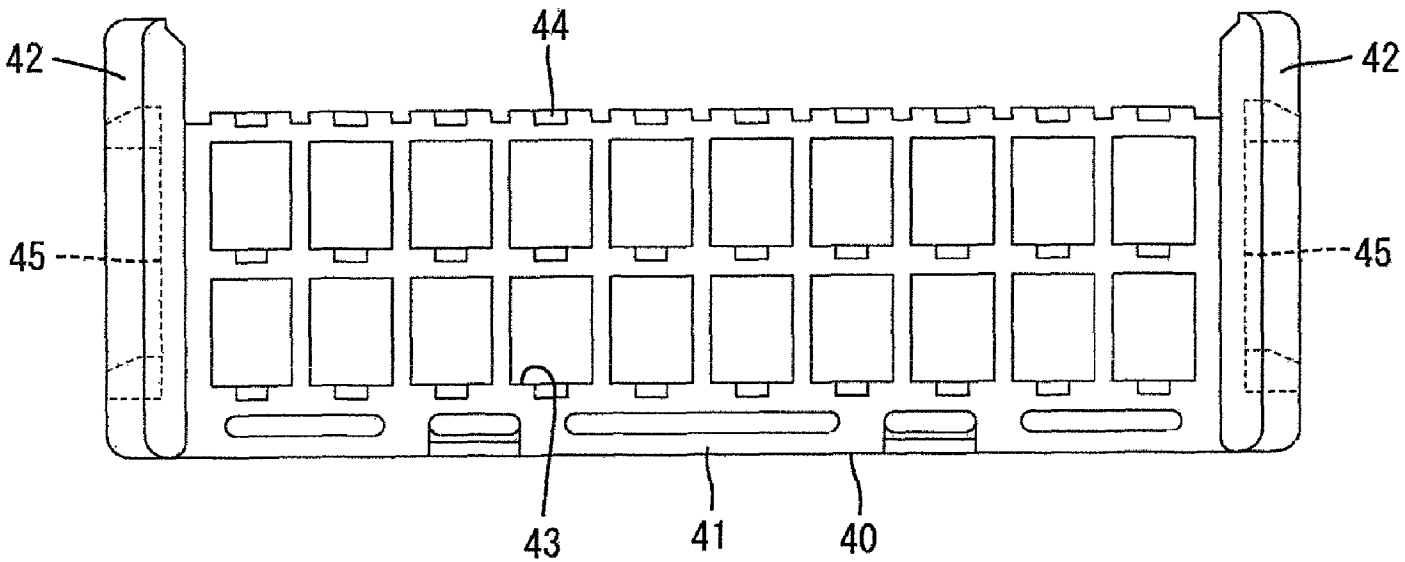
FIG. 10 is a front view of the retainer.
Figure 11:
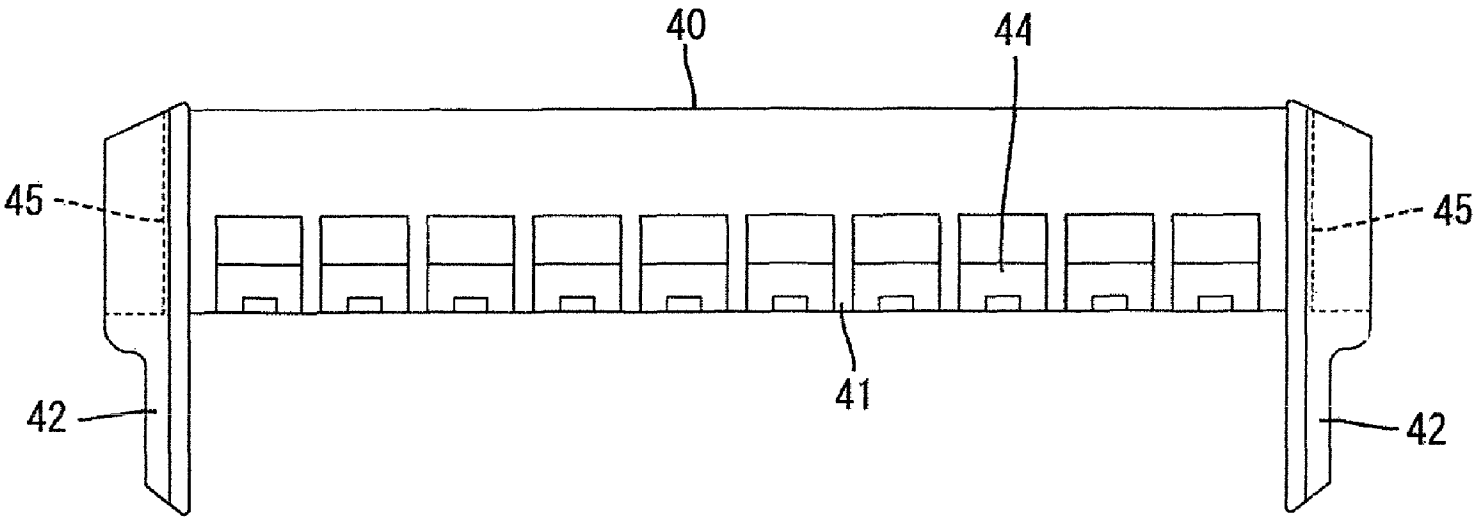
FIG. 11 is a plan view of the retainer.

The retainer 40 is made e.g. of synthetic resin and has a wide block-shaped retainer main body 41 that can be inserted into the mounting hole 27. Side plates 42 are connected with opposite side surfaces of the retainer main body 41, as shown in FIGS. 9 to 11. The retainer main body 41 is formed with window holes 43 that communicate with the respective small cavities 24 except the small cavities 24 at the upper level when the retainer main body 41 is mounted into the central tower 16. Retaining portions 44 project on the upper end surface of the retainer main body 41 and the inner lower surfaces of the respective window holes 43 in one-to-one correspondence with the small cavities 24. The retainer 40 is mounted movably between a partial locking position and a full locking position with respect to the central tower 16 in a vertical displacement direction that is substantially orthogonal to the connecting direction and parallel to a shorter side direction of the housing 10. The retainer main body 41 is inserted lightly in the mounting hole 27 at the partial locking position and the retaining portions 44 are located outside the small cavities 24, thereby permitting insertion and withdrawal of the terminal fittings 100 into and from the small cavities 24. On the other hand, the retainer main body 41 is deep in the mounting hole 27 at the full locking position so that the retaining portions 44 enter the small cavities 24 to retain the properly inserted terminal fittings 100.

Each terminal fitting 100 is formed by bending, folding and/or embossing a unitary electrically conductive metal plate and includes a rectangular tubular connecting portion 101 to be connected electrically to a mating terminal. A wire barrel 102 is formed behind the connecting portion 101 and is crimped, bent or folded connection to an end of a wire 300. A bottom wall of the connecting portion 101 has a locking hole 103 that receives the locking lance 25 when the terminal fitting 100 is inserted properly into the corresponding cavity 26. Further, the corresponding retaining portion 44 of the retainer 40 is engageable with the rear end edge of the connecting portion 101.

The side plates 42 of the retainer 40 have rectangular shapes slightly larger than the opposite side surfaces of the retainer main body 41 and cover the opposite side surfaces of the central tower 16 from outer sides when the retainer 40 is mounted.

Rear portions of the side plates 42 are thicker than front portions thereof and bulges out. Recesses 45 are formed in the outer surfaces of the rear portions of the side plates 42 to form openings at rear ends. An unlock linking portion 46 and a mount linking portion 47 are formed at the recess 45 of each side plate 42. The unlock linking portion 46 is inclined obliquely up to the back at a rear end of the bottom edge of each recess 45 and substantially reaches the rear end of the side plate 42. The mount linking portion 47 is inclined obliquely up to the back at a rear end of the upper edge of each recess 45 and substantially reaches the rear end of the side plate 42. The linking portions 46 and 47 are substantially parallel. Substantially horizontal straight portions 48 extend in forward and backward directions at upper and lower edges of each recess 45 before and continuous with the unlock linking portion 46 and the mount linking portion 47.

Figure 12:
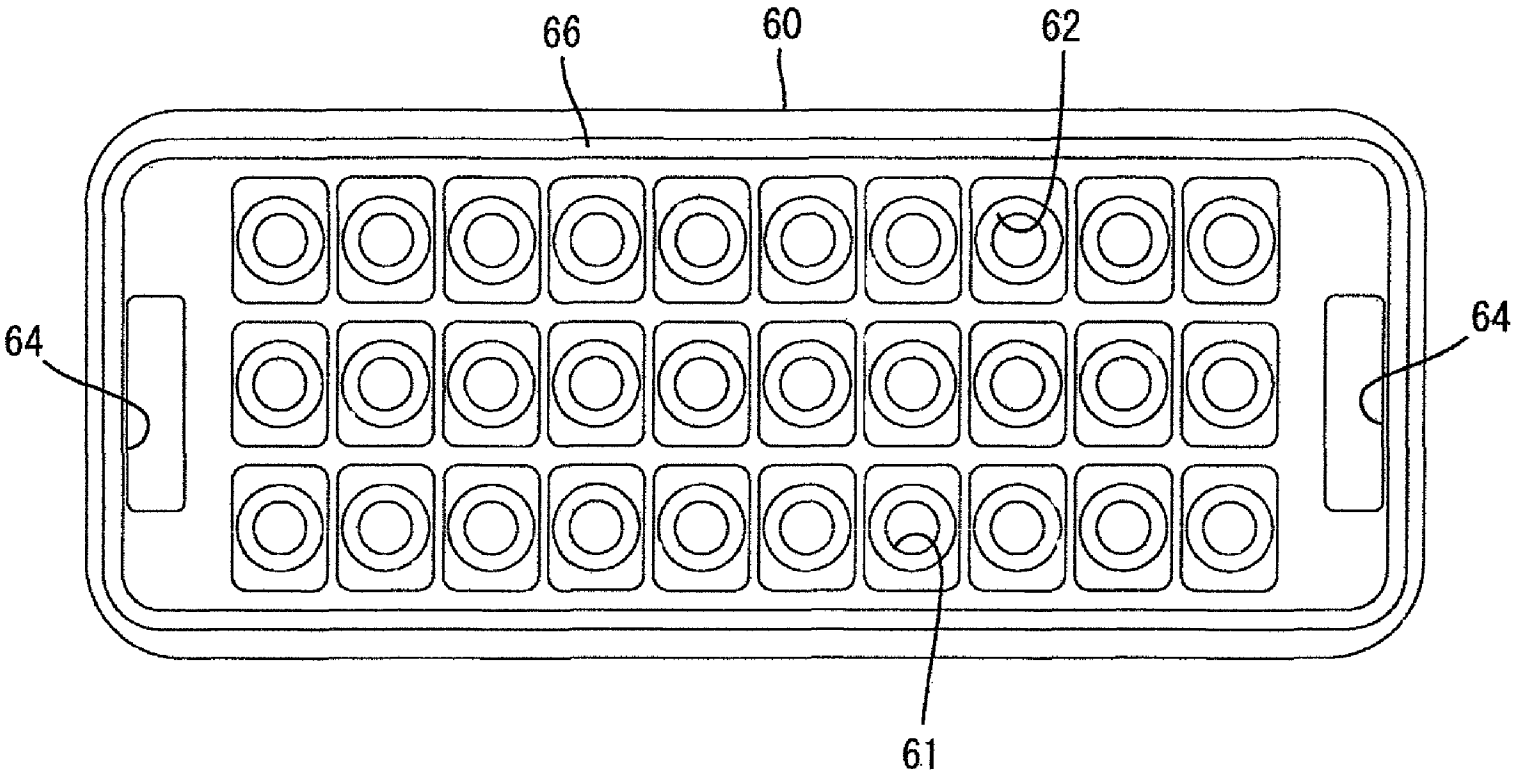
FIG. 12 is a front view of the rubber plug.

The resilient plug 60 is made of resilient material, such as silicon rubber, and defines a wide mat, as shown in FIG. 12. The resilient plug 60 is formed with through holes 61 at positions corresponding to the small cavities 24. Each through hole 61 is substantially round and has an opening diameter slightly smaller than a diameter of the wire 300. Inner lips 62 project on the inner circumferential surface of each through hole 61. The wire 300 connected to the terminal fitting 100 is inserted into each through hole 61 after the passage of the terminal fitting 100. The inner lips 62 closely contact the outer circumferential surfaces of the wires 30 while being resiliently compressed to provide sealing between the wires 300 and the resilient plug 60. Further, the outer circumferential surface of the resilient plug 60 closely contacts the inner circumferential surface of the mounting recess 17 of the housing main body 14 while being resiliently compressed to provide sealing between the housing 10 and the resilient plug 60.

Two insertion holes 64 penetrate opposite widthwise side portions of the resilient plug 60 at the opposite sides of an area of the respective through holes 61. The insertion holes 64 are narrow and long in the vertical direction.

A projection 66 is formed on the front surface of the resilient plug 60 slightly inward from the outer periphery of the resilient plug 60 so that the through holes 61 and the insertion holes 64 are surrounded by the projection 66. The projection 66 has a substantially semicircular cross section. On the other hand, a recess 29 is formed in the back surface of the mounting recess 17 of the housing 10 at a position corresponding to the projection 66. The recess 29 has a substantially having a U-shaped cross section and receives the projection when the resilient plug 60 is inserted into the mounting recess 17.

Figure 6:
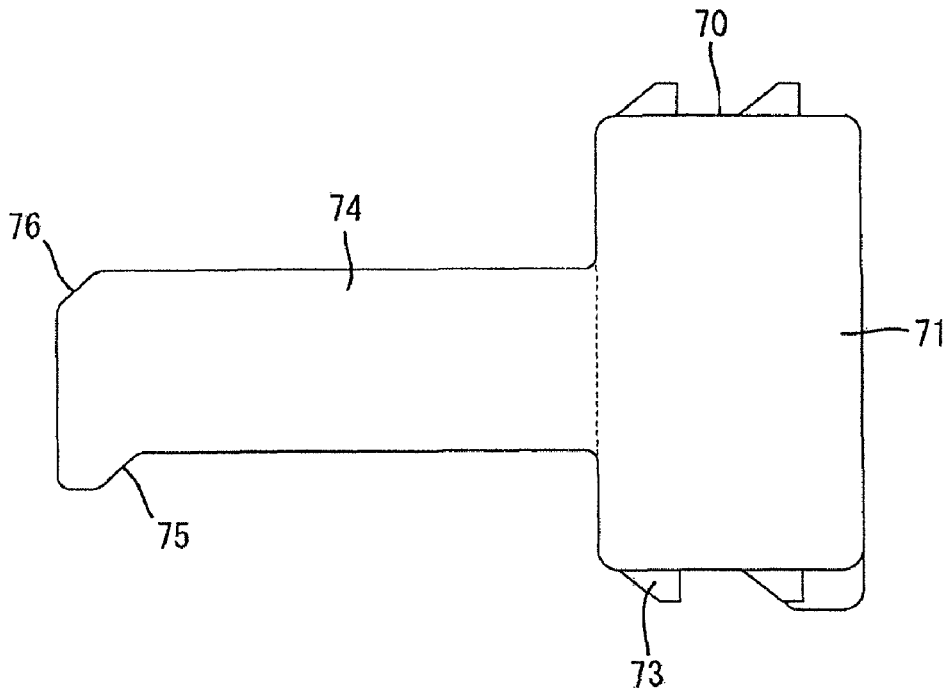
FIG. 6 is a side view of the rubber plug pressing member.
Figure 7:
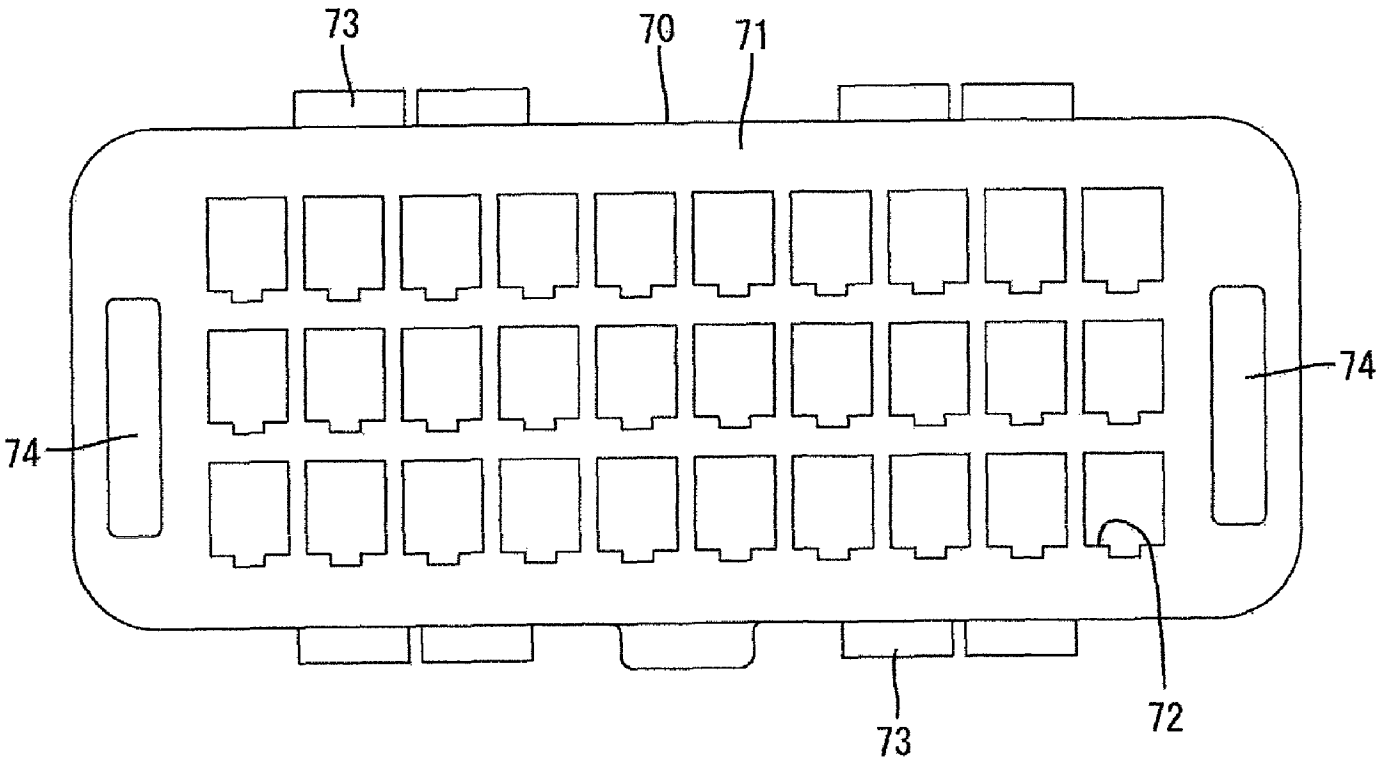
FIG. 7 is a front view of the rubber plug pressing member.
Figure 8:
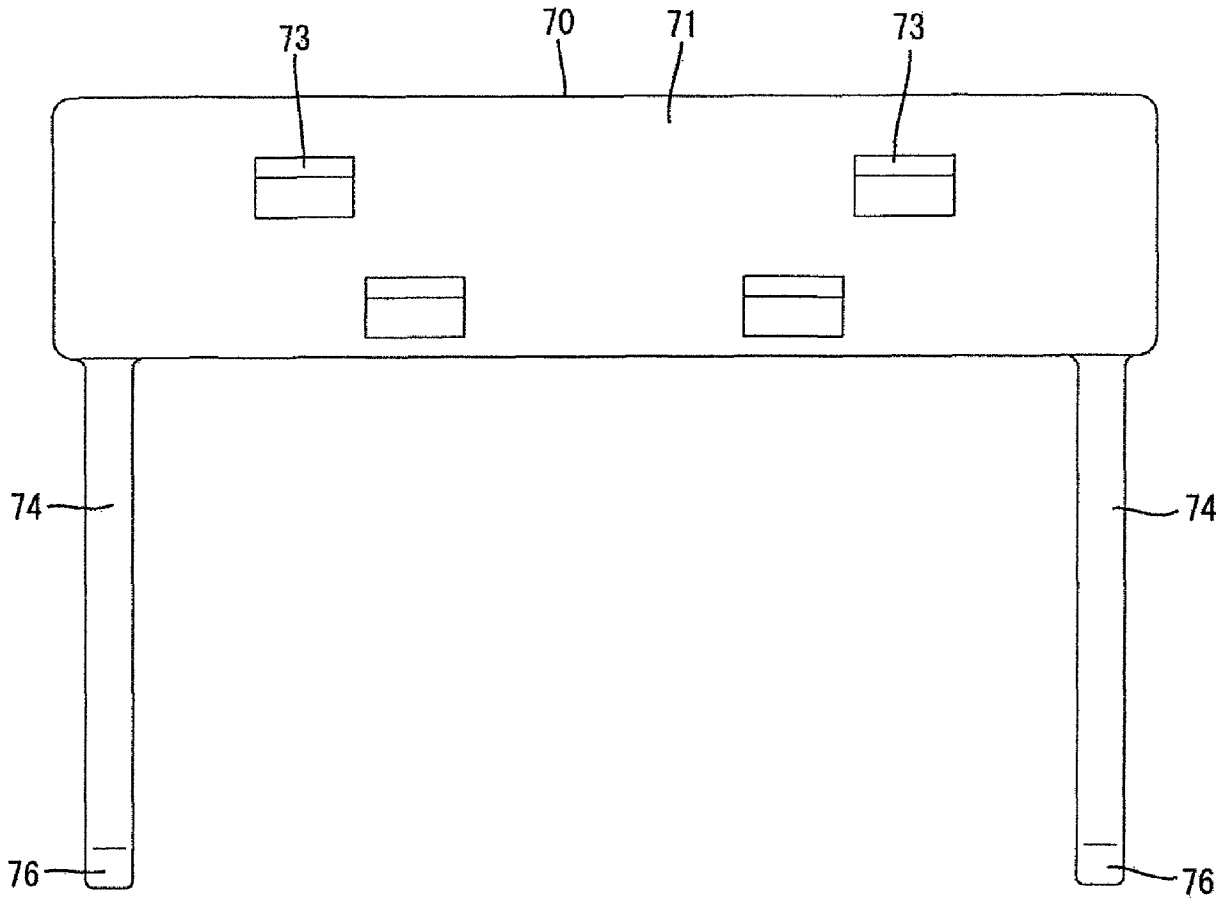
FIG. 8 is a plan view of the rubber plug pressing member.

The resilient plug pressing member 70 is made e.g. of synthetic resin and includes a pressing main body 71 having substantially the same outer cross section as the resilient plug 60, as shown in FIGS. 6 to 8. The pressing main body 71 has a thickness in forward and backward directions that exceeds a thickness of the resilient plug 60. Loose insertion holes 72 penetrate through the pressing main body 71 at positions corresponding to the through holes 61. Each loose insertion hole 72 has an opening shape corresponding to an outer cross section of the connecting portion 101 of the terminal fitting 100, and the wire 300 is inserted loosely therein. Locking projections 72 are formed at laterally spaced positions on the outer peripheral surface of the pressing main body 71. The resilient plug pressing member 70 is inserted in the mounting recess 17 and is movable in forward and backward directions between an initial position and a pushed-in position with respect to the housing main body 14. The resilient plug pressing member 70 is held at the respective initial and pushed-in positions with movements restricted by resiliently engaging the respective locking projections 73 with locking grooves 28 in the mounting recess 17. At the initial position, the resilient plug pressing member 70 is inserted lightly in the mounting recess 17 and the resilient plug 60 is held lightly between the front surface of the resilient plug pressing member 70 and the back surface of the mounting recess 17 without being compressed significantly in a thickness direction (see FIG. 2). On the other hand, at the pushed-in position, the resilient plug pressing member 70 is inserted deeply in the mounting recess 17 and the resilient plug 60 is held strongly between the front surface of the resilient plug pressing member 70 and the back surface of the mounting recess 17 while being compressed in the thickness direction so that the respective through holes 61 become narrower (see FIG. 3).

Two arms 74 project on the front surface of the pressing main body 71 at opposite sides of an area of the respective loose insertion holes 72. The arms 74 are parallel plates arranged in a vertical posture so that their thickness directions extend in the width direction. The arms 74 are inserted through the insertion holes 64 of the resilient plug 60 at the initial and pushed-in positions and into the clearances at the opposite sides of the central tower 16. Intermediate parts of the arms 74 closely contact the sealing surfaces of the insertion holes 64 and leading end portions of the arms 74 are inserted in the recesses 45 of the retainer 40. An unlock linking engaging portion 75 is formed at a leading end of the lower edge of each arm 74 and inclines obliquely up to the back. Further, a mount linking engaging portion 76 is formed at a leading end of the upper edge of each arm 74 and inclines obliquely up to the back. The unlock linking engaging portions 75 have substantially the same angle of inclination as the unlock linking portions 46 and slide in contact with the unlock linking portions 46 when the resilient plug pressing member 70 moves from the pushed-in position to the initial position. On the other hand, the mount linking engaging portions 76 have substantially the same angle of inclination as the mount linking portions 47 and slide in contact with the mount linking portions 47 when the resilient plug pressing member 70 moves from the initial position to the pushed-in position.

The retainer 40 initially is inserted into the mount hole 27 of the central tower 16 from below and is held at the partial locking position. Additionally, the resilient plug 60 and the resilient plug pressing member 70 are inserted into the mounting recess 17. In this case, the resilient plug 60 and the resilient plug pressing member 70 can be handled as a single unit by inserting the arms 74 of the resilient plug pressing member 70 into the corresponding insertion holes 64 of the resilient plug 60 beforehand. The projection 66 of the resilient plug 60 is fit into the recess 29 without being compressed when the resilient plug pressing member 70 is held at the initial position, as shown in FIG. 4. Further, the mount linking engaging portions 76 of the arms 74 face the mount linking portions 47 of the retainer 40 in forward and backward directions and the bottom ends of the unlock linking engaging portions 75 of the arms 74 contact the upper ends of the unlock linking portions 46 of the retainer 40, when the resilient plug pressing member 70 is held at the initial position. As a result, the retainer 40 is held at the partial locking position with movements thereof restricted.

The terminal fittings 100 then are inserted into the small cavities 24 of the central tower 16 from behind. Thus, each terminal fitting 100 successively passes the loose insertion hole 72 and the through hole 61. The resilient plug 60 is held in an uncompressed state during the insertion process, and hence the connecting portion 101 of the terminal fitting 100 will not exert a large frictional force on the inner circumferential surface of the through hole 61.

Figure 5:
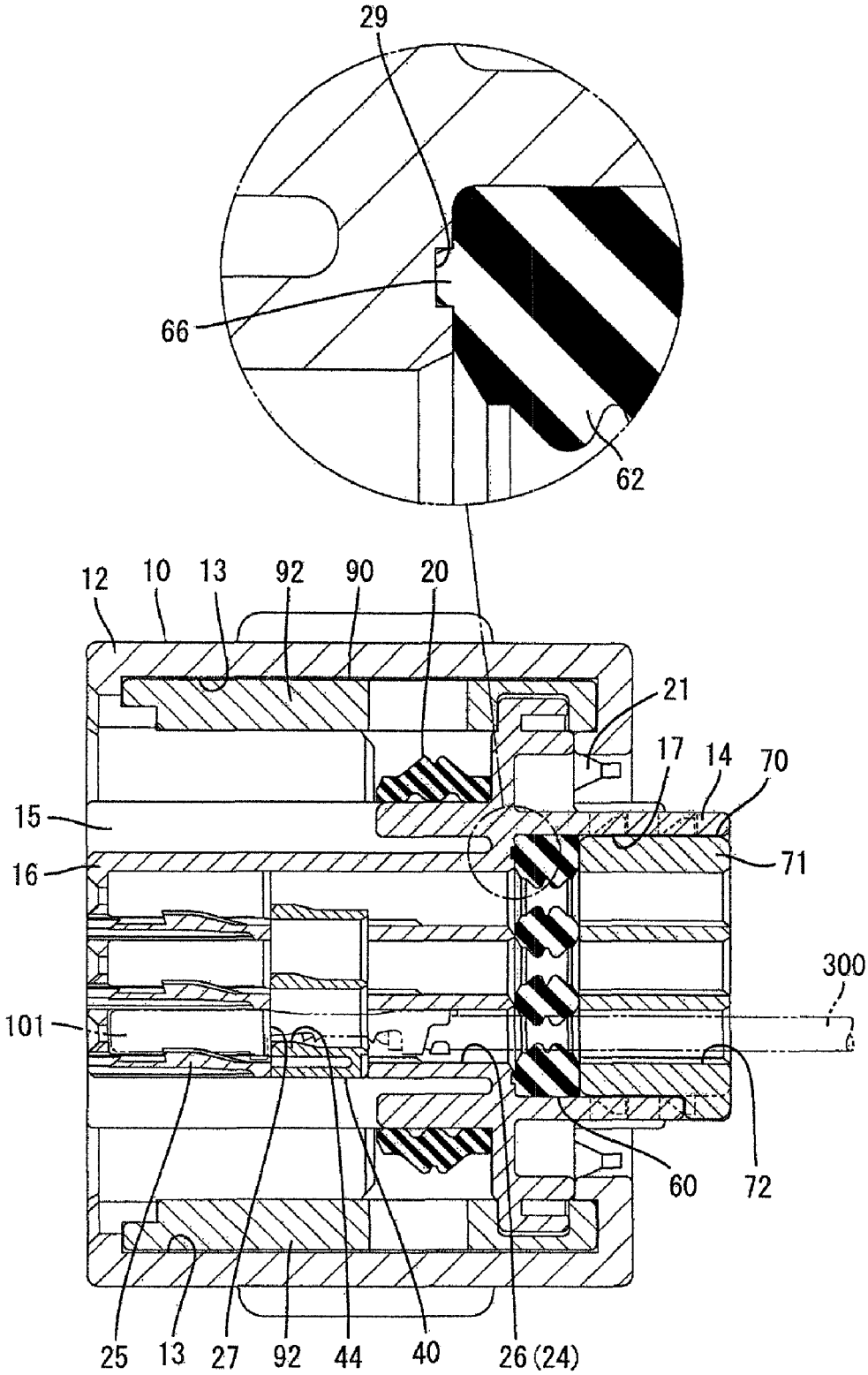
FIG. 5 is a sectional view showing a state where the rubber plug pressing member is at the pushed-in position and the projection of the rubber plug is fitted in the recess in a squeezed manner.

The retainer 40 is moved to the full locking position after the terminal fittings 100 are inserted into all the small cavities 24 and the resilient plug pressing member 70 may be pushed forward to the pushed-in position. The mount linking engaging portions 76 of the arms 74 slide in contact with the mount linking portions 47 of the retainer 40 so that a forward movement of the resilient plug pressing member 70 is translated into an upward movement of the retainer 40. As a result, the retainer 40 is moved toward the full locking position. The retaining portions 44 of the retainer 40 engage the connecting portions 101 of the terminal fittings 100 from behind when the retainer 40 reaches the full locking position. Thus, the terminal fittings 100 are locked doubly in cooperation with the locking lances 25. The resilient plug 60 is compressed in the thickness direction by bringing the retainer 40 to the full locking position and successively bringing the resilient plug pressing member 70 to the pushed-in position. The through holes 61 accordingly become narrower and the wires 300 are held closely over the entire circumferences. Further, as shown in FIG. 5, the projection 66 is squeezed and held in close contact with the inner surface of the recess 29 to hold the front surface of the resilient plug 60 and the back surface of the mounting recess 17 in a liquid-tight manner to seal the housing 10.

Figure 3:
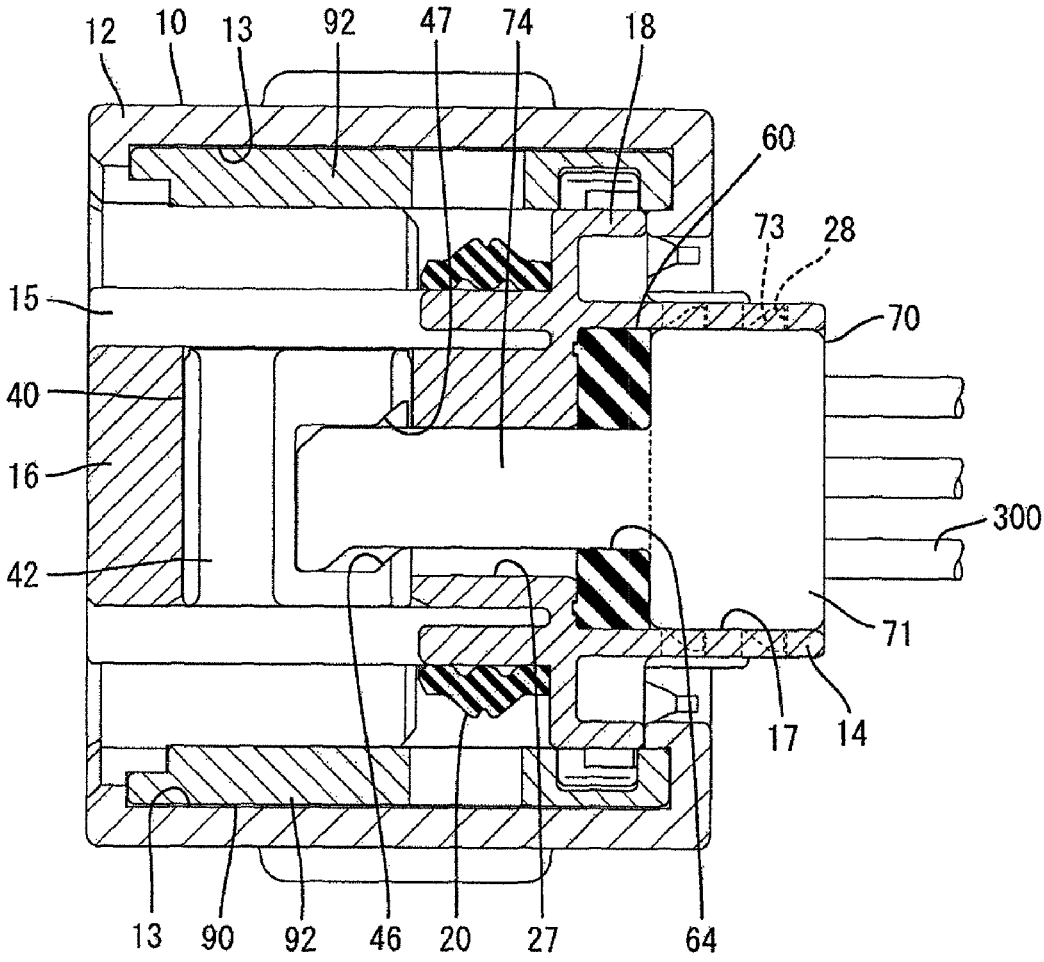
FIG. 3 is a sectional view showing a state where the rubber plug pressing member is at a pushed-in position and the retainer is at a full locking position.

The arms 74 are inserted deeply into the respective recesses 45 while the upper edges of the arms 74 slide on the upper straight portions 48 of the recesses 45 after the retainer 40 reaches the full locking position. The resilient plug pressing member 70 starts compressing the resilient plug 60 while the arms 74 slide on the straight portions 48 after the mount linking engaging portions 76 slide on the mount linking portions 47. Further, as shown in FIG. 3, the upper edges of the arms 74 contact the upper straight portions 48 from below to prevent a returning movement of the retainer 40 to the partial locking position.

On the other hand, the resilient plug pressing member 70 may be pulled back from the pushed-in position to the initial position so that the terminal fittings 100 can be withdrawn from the cavities 26 for maintenance or another reason. Thus, the unlock linking engaging portions 75 of the arms 74 slide on the unlock linking portions 46 of the retainer 40 and a backward movement of the resilient plug pressing member 70 is translated into a downward movement of the retainer 40. Accordingly, the retainer 40 is moved toward the partial locking position. The retaining portions 44 of the retainer 40 are retracted from the connecting portions 101 of the terminal fittings 100 when the retainer 40 reaches the partial locking position. The locking lance 25 then can be deformed in an unlocking direction and the wire 300 can be pulled back so that the terminal fitting 100 can be withdrawn from the housing 10.

The resilient plug 60 is released from the compressed state when the resilient plug pressing member 70 moves to the initial position and the through holes 61 accordingly become wider. Thus, the terminal fitting 100 can pass the through hole 61 without large frictional resistance between the terminal fitting 100 and the inner circumferential surface of the through hole 61 and the terminal fitting 100 can be pulled smoothly out of the through hole 61.

The upper edges of the arms 74 slide in contact with the upper straight portions 48 and the bottom ends of the unlock linking engaging portions 75 slide in contact with the lower straight portions 48 immediately after the resilient plug pressing member 70 starts moving backward to the initial position. Thus, the retainer 40 is held at the full locking position for a while. The unlock linking engaging portions 75 slide in contact with the unlock linking portions 46 immediately before the resilient plug pressing member 70 reaches the initial position and after the resilient plug 60 is released from the compressed state. As a result, the retainer 40 then is moved toward the partial locking position. The bottom ends of the unlock linking engaging portions 75 contact the upper ends of the unlock linking portions 46 from above when the resilient plug pressing member 70 reaches the initial position, as shown in FIG. 2, to prevent movement of the retainer 40 to the full locking position.

As described above, the resilient plug pressing member 70 is returned from the pushed-in position to the initial position upon withdrawing the terminal fittings 100 from the housing 10. Thus, the unlock linking portions 46 slide in contact with the arms 74. The retainer 40 follows this movement of the resilient plug pressing member 70 and moves from the full locking position toward the partial locking position. Thus, it is not necessary to move the retainer 40 to the partial locking position and separately to move the resilient plug pressing member 70 to the initial position, thereby mitigating a work load and preventing a moving operation of the resilient plug pressing member 70 to the initial position from being forgotten.

If the retainer 40 returns to the partial locking position, the resilient plug pressing member 70 also returns to the initial position. Thus, the compressed state of the resilient plug 60 is released when withdrawing the terminal fittings 100, thereby avoiding large frictional resistance between the terminal fittings 100 and the inner circumferential surfaces of the through holes 61 when the terminal fittings 100 pass the through holes 61. Thus, the terminal fittings 100 will not damage the resilient plug 60.

The resilient plug pressing member 70 is moved from the initial position to the pushed-in position upon inserting the terminal fittings 100 into the housing 10. Thus, the mount linking portions 47 slide in contact with the arms 74. The retainer 40 follows this movement of the resilient plug pressing member 70 and moves from the partial locking position to the full locking position. Thus, there is no need to move the retainer 40 and the resilient plug pressing member 70 separately when inserting the terminal fittings 100, thereby mitigating a work load and preventing a moving operation of the resilient plug pressing member 70 to the pushed-in position from being forgotten.

The outer peripheral surfaces of the arms 74 are held in close contact with the sealing surfaces of the insertion holes 64 of the resilient plug 60 at the pushed-in position. Thus, water and other fluid cannot enter the housing 10 through the outer peripheral surfaces of the arms 74. Therefore, the arms 74 do not degrade fluid- or waterproofness.

The projection 66 is squeezed and held in close contact with the inner surface of the recess 29 at the pushed-in position to ensure better fluid- or waterproofing. The projection 66 and the recess 29 are formed over the entire peripheral edge of the front surface of the resilient plug 60 and in the periphery of the back surface of the mounting recess 17. Thus, sealing is provided completely in a peripheral direction of the housing 10 to ensure even better fluid- or waterproofness.

The invention is not limited to the above described and illustrated embodiment. For example, the following embodiments are also included in the technical scope of the present invention.

The resilient plug and the resilient plug pressing member may be united integrally.

The unlock linking portions may slide in contact with the arms by returning the retainer from the full locking position to the partial locking position and the resilient plug pressing member may follow this movement of the retainer and return from the pushed-in position to the initial position.

The mount linking portions may slide in contact with the arms by moving the retainer from the partial locking position to the full locking position and the resilient plug pressing member may follow this movement of the retainer and move from the initial position to the pushed-in position.

One or more lips may project from the inner circumferential surfaces of the insertion holes of the resilient plug, and end surfaces of the lips may serve as sealing surfaces to be held in close contact with the outer peripheral surfaces of the arms to ensure better fluid- or waterproofing characteristics.

What is claimed is:

1. A fluidproof connector, comprising:

a housing with at least one cavity for receiving at least one terminal fitting;

a retainer mounted to the housing for movement between first and second positions and including at least one retaining portion positioned with respect to the cavity at the first position to permit insertion and withdrawal of the terminal fitting into and from the cavity and inserted in the cavity at the second position to retain the terminal fitting properly inserted into the cavity;

a resilient plug mounted to the housing and including at least one through hole closely contacting the outer circumferential surface of a wire connected to the terminal fitting after passage of the terminal fitting; and a resilient plug pressing member mounted movably between an initial position and a pushed-in position with respect to the housing and compressing the resilient plug at the pushed-in position, the resilient plug pressing member including at least one arm slidably engaged with the retainer for linking a movement of the retainer from the second position to the first position with a movement of the resilient plug pressing member from the pushed-in position to the initial position, wherein at least one projection is formed on a front surface of the resilient plug with respect to a mounting direction into the housing, at least one recess is formed in a surface of the housing to be held in contact with the resilient plug, and the projection is squeezed and held in close contact with an inner surface of the recess at the pushed-in position.

2. The fluidproof connector of claim 1, wherein the resilient plug pressing member lightly holds the resilient plug on the housing at the initial position and compresses the resilient plug against the housing at the pushed-in position.

3. The fluidproof connector of claim 1, wherein the retainer is formed with at least one mount linking portion sliding in contact with the arm for linking a movement of the retainer from the first position to the second position and a movement of the resilient plug pressing member from the initial position to the pushed-in position.

4. The fluidproof connector of claim 1, wherein the resilient plug has at least one insertion hole, a sealing surface being formed on an inner surface of the insertion hole and closely contact an outer peripheral surface of the arm at the pushed-in position.

5. The fluidproof connector of claim 4, wherein at least one lip projects from the inner surface of the insertion hole, and the sealing surface is formed on the lip.

6. The fluidproof connector of claim 1, wherein the projection and the recess are respectively formed around entire peripheries of the respective surfaces of the resilient plug and the housing.

7. The fluidproof connector of claim 1, wherein the resilient plug pressing member compresses the resilient plug at the pushed-in position to deform the through hole into closer contact with the wire.

8. A fluidproof connector, comprising:

a housing with at least one cavity;

a retainer mounted to the housing for movement in a moving direction between first and second positions and including at least one retaining portion that external of the cavity at the first position and projects into the cavity at the second position, the retainer having opposite side plates and rearwardly open recesses being formed in outwardly facing surfaces of the side plates, each recess having two opposed surfaces spaced apart in the moving direction;

a resilient plug mounted to the housing and including at least one through hole aligned with the cavity; and a resilient plug pressing member mounted movably between an initial position and a pushed-in position with respect to the housing and compressing the resilient plug sufficiently at the pushed-in position to reduce cross-sectional dimensions of the through hole, the resilient plug pressing member including arms having outer surfaces facing in opposite directions and spaced apart in the moving direction of the retainer, the arms being slidably engaged with the recesses in the side plates of the retainer so that the arms are between the side plates and walls of the housing and so that the outer surfaces of each of the arms engage the opposed surfaces of the respective recess for linking a movement of the retainer from the second position to the first position with a movement of the resilient plug pressing member from the pushed-in position to the initial position.

9. The fluidproof connector of claim 8, wherein at least one projection is formed on a front surface of the resilient plug with respect to a mounting direction into the housing, at least one recess is formed in a surface of the housing to be held in contact with the resilient plug, and the projection is squeezed and held in close contact with an inner surface of the recess at the pushed-in position.

10. The fluidproof connector of claim 8, wherein the retainer has at least one mount linking portion sliding in contact with the arm for linking a movement of the retainer from the first position to the second position and a movement of the resilient plug pressing member from the initial position to the pushed-in position.

11. The fluidproof connector of claim 8, wherein the resilient plug has at least one insertion hole, a sealing surface being formed on an inner surface of the insertion hole and closely contacting an outer peripheral surface of the arm at the pushed-in position.

* * * * *